United States Patent [19]

Guss

[11] Patent Number: 4,994,076

[45] Date of Patent: Feb. 19, 1991

[54] INFANT NURSING DEVICE

[76] Inventor: Barron Guss, 821 Cooke St., Honolulu, Hi. 96813

[21] Appl. No.: 427,064

[22] Filed: Oct. 25, 1989

[51] Int. Cl.[5] ..... A61J 17/00

[52] U.S. Cl. ..... 606/236; 215/11.1; 215/11.4

[58] Field of Search ..... 606/234–236; 215/11.1, 11.2, 11.4, 11.5; 15/104.16, 104.2, 164

[56] References Cited

U.S. PATENT DOCUMENTS

| | | | |
|---|---|---|---|
| 102,417 | 4/1870 | Mason | 215/11.1 |
| 154,562 | 9/1874 | Perkins | 215/11.1 |
| 3,263,848 | 8/1966 | Zackheim | 215/11.1 |
| 3,267,937 | 8/1966 | Verschoor | 606/236 |

FOREIGN PATENT DOCUMENTS

| | | | |
|---|---|---|---|
| 0003705 | 3/1888 | United Kingdom | 215/11.1 |
| 0013516 | of 1902 | United Kingdom | 215/11.1 |
| 2067416 | 7/1981 | United Kingdom | 215/11.4 |

*Primary Examiner*—C. Fred Rosenbaum
*Assistant Examiner*—William Lewis
*Attorney, Agent, or Firm*—Jordan and Hamburg

[57] ABSTRACT

An infant nursing device for permitting an infant to ingest by means of a nipple a liquid contained in a nursing bottle remote from the nipple includes a closure for the nursing bottle, the closure having a conduit passing through it, a nipple holder for holding the nipple with a liquid-tight seal, the nipple holder havng a conduit through it communicating between the exterior and the interior of the nipple, a segment of flexible tubing one end of which is connected to the end of the closure conduit which is inside the bottle when the closure is on the bottle and the other end of which, preferably weighted, approximately reaches the bottom of the bottle when the closure is on the bottle, and another segment of flexible tubing one end of which is connected to the end of the closure conduit which is outside the bottle when the closure is on the bottle and the other end of which is connected to the end of the nipple holder conduit which is exterior to the nipple. Together with the nursing device there may be included a device for cleaning the nursing device.

4 Claims, 2 Drawing Sheets

2
2
30
11
50
10
29
13
3
3
12

L
11
38a
37b
38
37
36
36a
37a
39a
42
16
32
30
39b
31
39
36b
40
34
29b
35a
35
29
33
41
43
15
31a
14

INFANT NURSING DEVICE

BACKGROUND OF THE INVENTION

This invention relates to an infant nursing device, more particularly to a device for permitting an infant to ingest by means of a nipple a liquid contained in a nursing bottle remote from the nipple, and to a device for cleaning the nursing device.

It is sometimes desired to nurse an infant by means of a nursing bottle while not otherwise attending to the infant. To this end, a care provider may, for example, lie an infant on the mattress of a crib or baby carriage and prop up the bottle by means of pillows or folded blankets or the like to elevate the bottom of the bottle, whereupon the infant suckles upon the nipple. This is unsatisfactory in more than one respect. The bottle is prone to fall from its propping support. Also, the infant may choke on the nursing bottle liquid contents because vigorous sucking by the infant may provide an excessive flow of the liquid since the nipple is continually filed by gravity. The latter is not a problem when one is feeding an infant in one's arms or otherwise attending the infant during feeding, because one is there to withdraw the nipple from the infant's mouth at the onset of choking. This is not, however, the case when the infant is unattended while suckling on the nipple of a propped bottle.

It is, therefore, an object of the invention to provide a device to permit an infant to suckle on a nursing bottle while unattended without risk of the infant's suckling being interrupted by dislocation of the bottle and without risk of the infant ingesting the nursing bottle liquid contents so rapidly as to choke.

More particularly, it is an object of the invention to provide a device for permitting an infant to ingest the nursing bottle liquid contents by means of a nipple remote from the bottle.

It is a further object of the invention to provide a device for cleaning the infant nursing device of the invention.

Other objects and advantages of the invention will be apparent from the following descriptions of the invention.

SUMMARY OF THE INVENTION

According to one aspect of the invention, there is provided an infant nursing device for permitting an infant to ingest by means of a nipple a liquid contained in a nursing bottle remote from the nipple. The device includes a closure for the nursing bottle, the closure having a conduit passing through it, a nipple holder for holding the nipple with a liquid-tight seal, the nipple holder having a conduit through it communicating between the exterior and the interior of the nipple, a segment of flexible tubing one end of which is connected to the end of the closure conduit which is inside the bottle when the closure is on the bottle and the other end of which, preferably weighted, approximately reaches the bottom of the bottle when the closure is on the bottle, and another segment of flexible tubing one end of which is connected to the end of the closure conduit which is outside the bottle when the closure is on the bottle and the other end of which is connected to the end of the nipple holder conduit which is exterior to the nipple.

According to another aspect of the invention, there may be included with the nursing device, or sold separately, a device for cleaning the nursing device. The cleaning device is in the form of a flexible elongated generally cylindrical member having a gently abrasive surface. The member is of diameter approximately the same as or slightly less than and length at least approximately the same as the interior diameter and total length, respectively, of the tubing segments and conduits. The cleaning device has a dial or knob or other gripping means affixed to an end of the elongated member for facilitating manual rotation of the elongated member after it has been inserted into the tubular segments and conduits of the nursing device.

BRIEF DESCRIPTION OF THE DRAWINGS

The invention will hereinbelow be further described by reference to a preferred embodiment as illustrated in the drawings, in which.

DETAILED DESCRIPTION OF A PREFERRED EMBODIMENT

The herein described preferred embodiment of the infant nursing device 10 (FIGS. 1 and 4) of the invention is used in conjunction with a conventional nursing bottle 11 (FIGS. 1 and 2), typically made of a rigid or flexible plastic, conventional nipple 12 (FIGS. 1, 3 and 4), typically made of rubber or a rubbery plastic, and a conventional nipple holder 13 (FIGS. 3 and 4), typically made of a rigid plastic. That embodiment has the advantage of obviating duplicative purchases and making it possible for the infant's care provider to provide the infant alternatively with a nursing bottle having a nipple conventionally mounted directly thereon or having a nipple remotely connected thereto, with the use of only a single nursing bottle 11, nipple 12 and nipple holder 13 in conjunction with the nursing device 10 of the invention, the latter being used only for connecting the nipple 12 remotely to the bottle 11.

Figure 2:
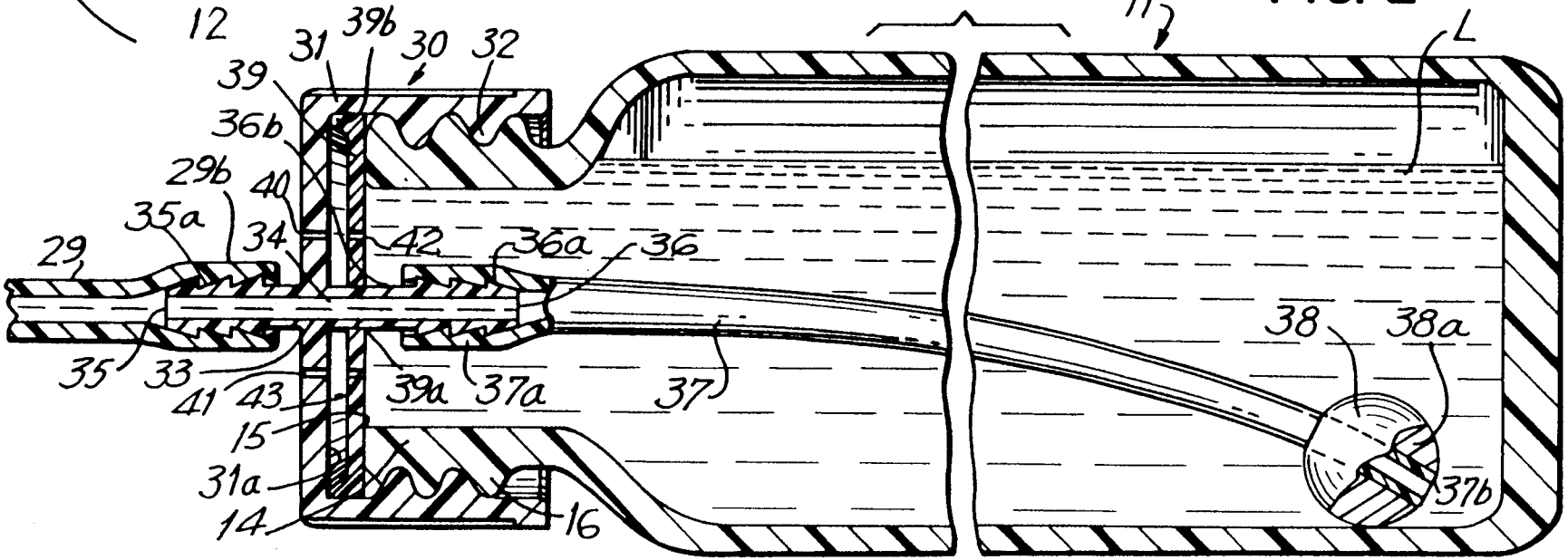
FIG. 2 is a cross sectional view of the nursing bottle and a portion of the infant nursing device taken on section line 2—2 of FIG. 1.

The conventional nursing bottle 11 has an end 14, typically configured as a neck, provided with a mouth 15 and circumscribed by external threads 16 (FIG. 2). The conventional nursing bottle nipple holder 13 is of screw cap bottle closure-like configuration but having an opening 17 for receiving the nipple 12 (FIG. 2). The opening is circumscribed by a radially inwardly extending flange portion 18 of the nipple holder 13. The nipple holder 13 has internal threads 19 adapted to mate with the eternal threads 16 of the nursing bottle 11. The nipple holder 13 also has external flutes 20 to facilitate manual rotation of the nipple holder 13.

Figure 3:
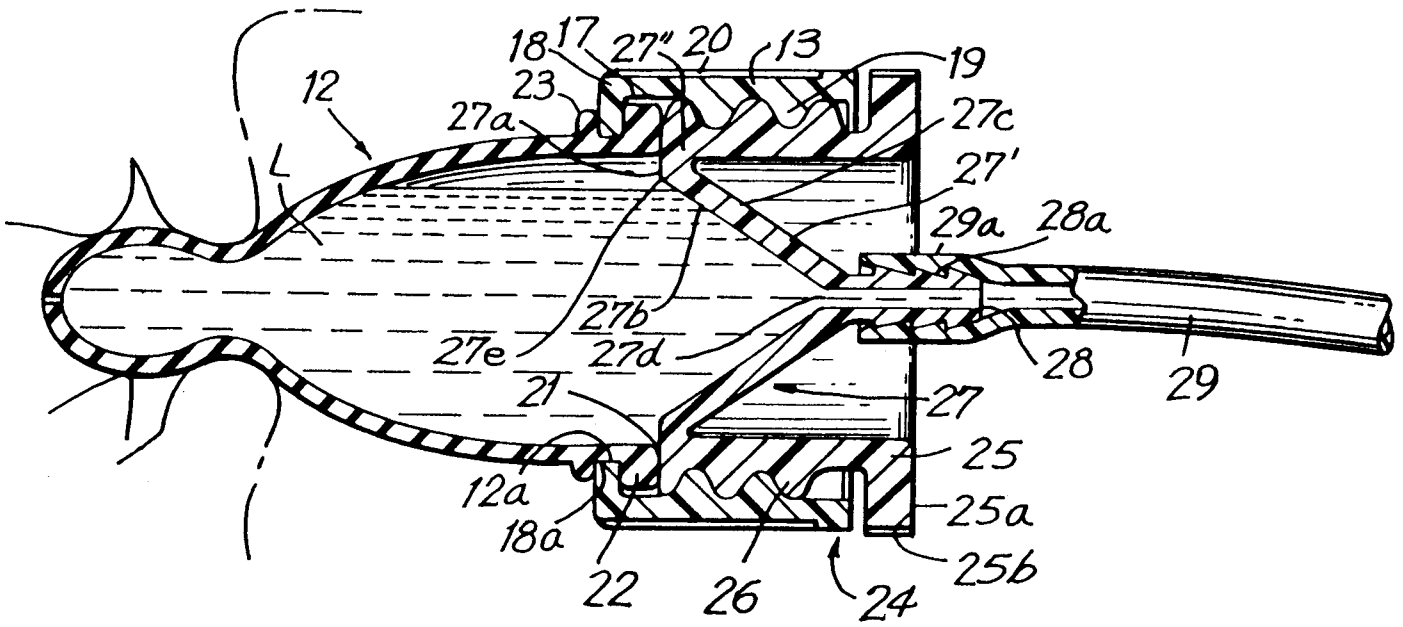
FIG. 3 is a cross sectional view of a portion of the infant nursing device, including the nipple, taken on section line 3—3 of FIG. 1.
Figure 4:
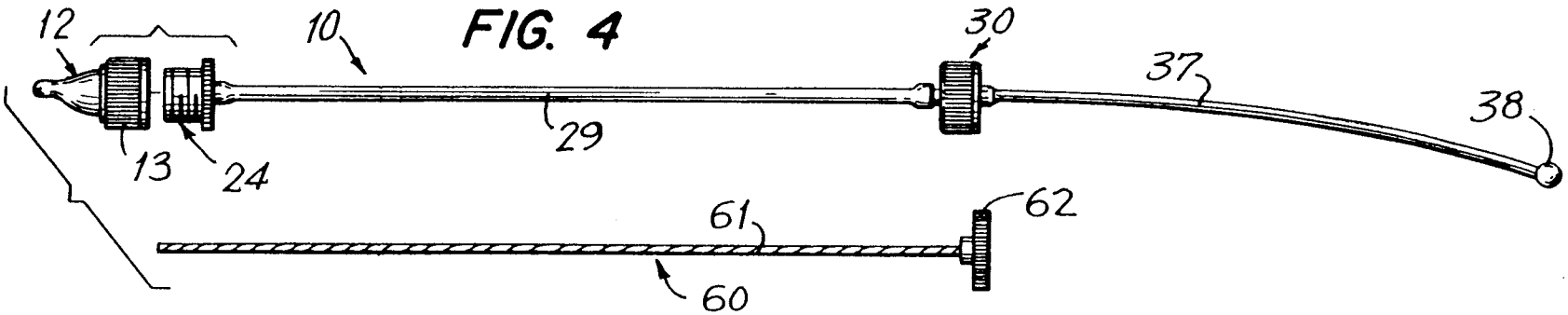
FIG. 4 is a side view of the infant nursing device together with a cleaning device for cleaning the infant nursing device.

The conventional nursing bottle nipple 12 has a mouth 21 circumscribed by a radially outwardly extending annular flange 22 (FIG. 3). The nipple 12, which is resilient, is received through the opening 17 of the nipple holder 13 until the nipple flange 22 abuts against the nipple holder flange 18, the radially inward face **18*a* of the flange 18 engaging a diametrically opposite exterior face portion 12*a* of the nipple 12. The nipple 12 is also provided with a bead 23, the nipple holder flange 18 being snugly received between the bead 23 and the nipple flange 22**.

Conventionally, the nipple holder 13, with the nipple 12 inserted therein as illustrated in FIG. 3, would be screwed onto the mouth end of the bottle 11, the threads 19 of the nipple holder 13 mating with the threads 16 of the bottle and the nipple flange 22 being held by the nipple holder flange 18 in liquid-tight sealing engagement with the mouth 15 of the bottle 11. This is not illustrated. Instead, in FIG. 3, the nipple holder 13 with the nipple 12 conventionally received therein, are illustrated as part of a remote nipple holding assembly 24 according to the invention.

The assembly 24 further includes a cylindrical nipple support member 25, which may conveniently be made of a rigid plastic, having external threads 26 which replicate the threads 16 of the bottle 11. To facilitate gripping of the nipple support member 25 when the nipple support member 25 and the nipple holder 13 are mated by mating of the threads 26 with the threads 19, the nipple support member 25 is provided at one end with an annular flange 25*a* having a fluted cylindrical surface 25*b*. The other end 27″ of the nipple support member has an annular obverse surface 27*a*. The nipple support member 25 has a partition wall 27 in the form of a hollow cone 27′. Partition wall 27 provides a conical surface 27*b* on its obverse side and with which the annular obverse surface 27*a* is contiguous. The other, i.e., inverse side, of the partition wall 27 is a conical surface 27*c*. When the nipple holder threads 19 are mated with the nipple support member threads 26, the nipple flange 22 is clamped between the nipple holder flange 18 and the obverse surface 27*a* of the nipple support member 25 to form a liquid-tight seal in the same manner that, conventionally, a liquid-tight seal would be formed by liquid-tight sealing engagement of the nipple flange 22 with the mouth 15 of the bottle 11.

On the inverse surface 27*b* of the nipple support member 25 is provided a connecting portion 28, in the form of a rigid tubular extension, extending axially of the member 25 away from the surface 27*b*. A flexible tubing segment 29, which may conveniently be made of a rubber or rubbery plastic and preferably is made of a silicone rubber, has an end 29*a*, which is received, by stretching, onto the connecting portion or tubular extension 28. The connecting portion or tubular extension 28 is provided with external barbs or crenulations 28*a* to resist sliding of the tubing end 29*a* off the tubular extension 28.

The other end 29*b* of the tubing segment 29 is connected to a nursing bottle closure 30 according to the invention. The closure 30 includes a cap portion 31 having internal threads 32 which replicate the threads 19 of the nipple holder 13 and, consequently, mate with the threads 16 of the bottle 11. The closure 30 also has a portion defining a connection device 33 in the form of an axial aperture 34 through the cap portion 31 communicating with respective rigid tubular extensions 35 and 36 projecting axially of the cap portion 31 respectively away from and into the bottle 11. The tubing end 29*b* is received, by stretching, onto the tubular extension 35 and an end 37*a* of a second tubing segment 37 is received, by stretching onto the tubular extension 36. The tubular extensions 35 and 36 are respectively provided with barbs or crenulations 35*a* and 36*a* to resist sliding of the tubing ends 29*b* and 37*a* off the respective tubular extensions 35 and 36.

The other end 37*b* of the tubing segment 37 is of such length to at least approximately reach the bottom of the bottle 11 and has mounted thereon a spherical weight 38 of specific gravity greater than the specific gravity of liquids to be contained in the nursing bottle (typically, milk, an infant nursing formula, water or a fruit juice). The spherical weight may be made for example of stainless steel or a high specific gravity plastic. The weight 38 is provided with an axial bore 38*a* into which the tubing end 37*b* tightly fits.

The closure 30 also includes a gasket 39 made of a rubber or a rubbery plastic and provided with an axial aperture 39*a* by means of which it is received on a barb- or crenulation-free portion 36*b* of the tubular extension 36. The gasket 39 is formed with an upturned annular lip 39*b* at its periphery. The thickness, i.e., the dimension parallel to the gasket axis, of the gasket at the lip 39*b* is equal to the corresponding dimension of the nipple flange 22. Consequently, when the closure threads 32 are mated with the bottle threads 16, interior upper surface 31*a* of the cap 31 abuts against the gasket lip 39*b*, clamping the gasket 39 between the cap surface 31*a* and the bottle mouth 15 to form a liquid-tight seal in the same manner that, conventionally, a liquid-tight seal would be formed by liquid-tight sealing engagement of the nipple flange 22 with the bottle mouth 15.

To prevent air pressure in the bottle 11 from decreasing to below that of the ambient atmosphere as the volume of liquid L in the bottle 11 (FIG. 2) decreases as a result of the infant's ingestion of the liquid L, which decrease in pressure would impede and eventually prevent the infant from sucking the liquid L from the bottle 11 to the remote nipple 12 from which the infant ingests the liquid L (FIG. 3), the cap 39 is provided with pinholes 40 and 41 and the gasket 39 is provided with pinholes 42 and 43, the pinholes 40 to 43 being too small in diameter relative to their axial length to permit outflow of liquid from the bottle 11 but providing sufficient communication of air between the ambient and the interior of the bottle 11 to maintain the air pressure in the bottle 11 at the ambient air pressure as the volume of the liquid L in the bottle 11 decreases.

Figure 1:
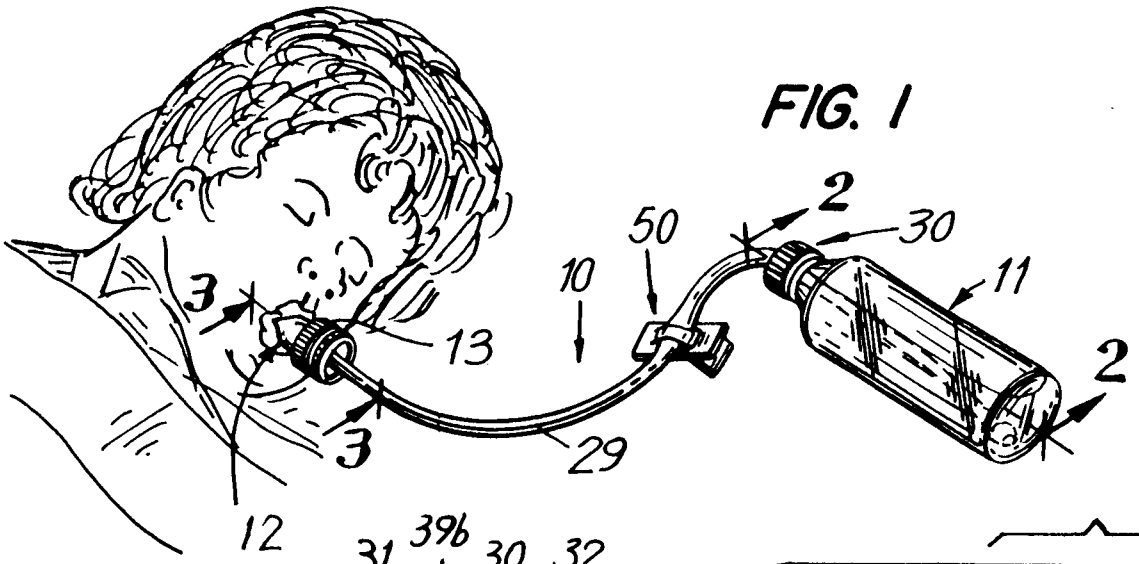
FIG. 1 is an isometric view of the infant nursing device of the invention in use by an infant.

Use of the nursing device 10 of the invention is apparent from FIG. 1. The nursing bottle 11 is resting on a mattress on which an infant is lying. The infant sucks on the nipple 12 and the nursing device 10 of the invention conducts the liquid in the bottle 11 from the bottle 11 to the nipple 12 from which the infant ingests the liquid. On the tubing segment 29 is mounted a pinch clamp 50 of conventional construction which is operable between an open configuration in which it does not restrict flow of liquid through the tubing segment 29 and a closed configuration in which it pinches the tubing segment 29 thereby to prevent the flow of liquid therethrough. Closing of the pinch clamp 50 by one caring for the infant permits the infant to use the nipple 12 as a pacifier, without ingesting liquid or air from downstream of the pinch clamp 50.

A cleaning device 60 (FIG. 4) of the invention is in the form of a flexible elongated generally cylindrical member 61 of diameter approximately the same as or slightly less than and length at least approximately the same as the interior diameter and total length, respectively, of the tubing segments and conduits of the nursing device 10 and to an end of which is affixed a dial or knob or other gripping means 62 for facilitating manual rotation of the elongated member 61 after it has been inserted into the tubular segments and conduits of the nursing device 10. The elongated member 61 may be inserted into the nursing device 10 either through the end 37*b* of the tubing segment 37 or through apex opening 27*d* of the conical surface 27*b* and then worked along until it reaches or emerges from either the apex opening 27*d* or the tubing segment end 37*b*, respectively. The elongated member 61 is rotated and axially reciprocated while thus received in the nursing device 10 to scour the interior walls of the conduits and tubing segments of the nursing device 10. The surface of the member 61 is gently abrasive throughout its length and circumference and its gentle abrasiveness permits it to scour away residues of the milk or other liquid without wearing the internal surfaces of the nursing device 10. It has been found that the core of a Bowden cable may conveniently serve as the member 61. However, many other materials will also be suitable, such as, for example, a nylon rod having a roughened surface.

When the device 10 is to be cleaned, the conventional nipple holder 13 and nipple 12 are disassembled therefrom. Mouth 27*e* of the conical surface 27*b* is wide enough to receive the outlet of a water tap, permitting the convenient running of water through the device 10 as a step in the cleaning thereof.

While the invention has been described by reference to a specific embodiment, it is to be understood that such description is intended to be illustrative and that the scope of the invention is intended to include the subject matter of the hereto appended claims and equivalents thereof. For example, the number of parts may be reduced when fabrication techniques permit. In principle, the tubing segments and the weight need not be discrete elements. The nipple holder need not have a conical inlet, though with the elimination thereof, its advantage is sacrificed. In principle, there is no reason, apart from economy, to make the surface 27*c* conical. The foregoing is not intended to be inclusive of all modifications within the spirit and scope of the invention.

What I claim is:

1. A device for permitting an infant to ingest by means of a nipple a liquid contained in a nursing bottle remote from the nipple, comprising a closure for the nursing bottle, the closure including means forming a conduit passing through the closure for conducting out of the bottle a liquid contained in the bottle, the closure having an obverse surface which is conical and coaxial with the conduit, the conical surface defining a mouth which is adapted to receive an outlet of a water tap, a first segment of flexible tubing having an end communicating with an end of the conduit at the interior of the closure and being of such length that another end of the first flexible tubing segment approximately reaches the bottom of the bottle, means for holding the nipple so that a fluid-tight seal is formed about a periphery of the nipple, means forming a conduit passing through the nipple holding means for communicating between the interior and the exterior of the nipple, and a second segment of flexible tubing having an end communicating with an end of the nipple holding means conduit located to be at the exterior of the nipple and having another end communicating with an end of the closure conduit at the exterior of the closure.

2. A device for permitting an infant to ingest by means of a nipple a liquid contained in a nursing bottle remote from the nipple and for use in combination with (a) a conventional nursing bottle having an end provided with a mouth, the end being circumscribed by external threads, (b) a conventional nursing bottle nipple holder having an opening for receiving the nipple, the opening being circumscribed by a radially inwardly extending annular flange, the nipple holder having internal threads adapted to mate with the external threads of the mouth end of the nursing bottle and (c) a conventional nursing bottle nipple having a mouth circumscribed by a radially outwardly extending annular flange adapted to be held by the flange of the nipple holder in liquid-tight sealing engagement with the mouth of the bottle, said device comprising a nursing bottle closure having an internally threaded cap portion adapted to be screwed onto the mouth end of the nursing bottle in place of the conventional nipple holder and a connecting device portion coaxial with the cap portion, the connecting device portion comprising means forming a channel communicating between the interior and the exterior of the bottle when the cap is screwed onto the bottle and having a first end projecting from the cap portion into the bottle and a second end projecting from the cap portion away from the bottle, first and second segments of flexible tubing, the first segment of flexible tubing having an end received on the first end of the connecting device and having another end on which a weight is received an being of such a length as to approximately reach the bottom of the bottle, the second segment of flexible tubing having an end received on the second end of the connecting device and another end connected to a remote nipple holding assembly, the remote nipple holding assembly comprising an externally threaded cylindrical nipple support member having an end having an annular obverse surface adapted to abut against the nipple flange, the member also having an end wall, the end wall having an obverse surface and also having an inverse surface, the external threads of the member being adapted to mate with the internal threads of the nursing bottle nipple holder to clamp the nipple flange between the nipple holder flange and the annular observe surface of the end of the member to form a liquid-tight seal, and the member having a connecting device portion on the inverse surface of the end wall and extending axially of the member away from said inverse surface, a conduit extending axially through the end wall and the connecting device portion of the member, said observe surface contiguous with the annular obverse surface being conical and coaxial with the conduit, the conical surface defining a mouth which is adapted to receive an outlet of a water tap, said other end of the second flexible tubing segment being received on the connecting device portion of the member.

3. A device according to claim 2, further comprising a gasket received in the cap portion of the closure for providing a liquid-tight seal when the cap is screwed onto the bottle.

4. A device according to claim 2, further comprising a pinch clamp received on the second segment of flexible tubing, said clamp being operable between a closed configuration in which it pinches the second segment of flexible tubing to prevent flow of liquid therethrough and an open configuration in which it does not restrict flow of liquid therethrough.

* * * * *